252-105 AU 115 EX
5/26/87 XR 4,668,475

United States Patent [19]
Meloy

[11] Patent Number: 4,668,475
[45] **Date of Patent: * May 26, 1987**

[54] CLEANING AND DISINFECTING METHOD AND ARTICLE OF MANUFACTURE INCLUDING COLOR DISPLAY

[75] Inventor: Gilbert K. Meloy, Cincinnati, Ohio

[73] Assignee: Twinoak Products, Inc., Plano, Ill.

[ * ] Notice: The portion of the term of this patent subsequent to Aug. 12, 2003 has been disclaimed.

[21] Appl. No.: 694,618

[22] Filed: Jan. 24, 1985

Related U.S. Application Data

[60] Continuation-in-part of Ser. No. 565,720, Dec. 27, 1983, which is a division of Ser. No. 364,786, Apr. 2, 1982, Pat. No. 4,435,857, and Ser. No. 545,876, Oct. 27, 1983, and Ser. No. 545,883, Oct. 27, 1983.

[51] Int. Cl.[4] ..... E03D 9/02; A61L 2/16

[52] U.S. Cl. ..... 422/37; 422/264; 422/266; 422/119; 4/227; 4/228; 116/206; 436/2; 436/164; 424/149; 252/94; 252/105

[58] Field of Search ..... 422/37, 262, 264, 266, 422/119; 436/2, 164; 424/149; 252/94, 105; 4/4, 227, 228; 116/206

[56] References Cited

U.S. PATENT DOCUMENTS

| | | | |
|---|---|---|---|
| 3,342,674 | 9/1967 | Kowalski | 422/37 X |
| 3,488,420 | 1/1970 | Keast | 422/37 X |
| 4,200,606 | 4/1980 | Kitko | 422/37 |
| 4,216,027 | 8/1980 | Wages | 4/228 X |
| 4,248,827 | 2/1981 | Kitko | 422/37 |
| 4,281,421 | 8/1981 | Nyquist et al. | 422/266 X |
| 4,438,534 | 3/1984 | Keyes et al. | 4/228 X |

*Primary Examiner*—David L. Lacey
*Attorney, Agent, or Firm*—James P. Ryther

[57] ABSTRACT

A cleaning and disinfecting article of manufacture and method are provided wherein the cleaning and disinfecting article of manufacture comprises a cleaning and disinfecting ingredient which includes a cleaning and disinfecting agent, a solid color indicator composition which includes a color indicator agent and a matrix agent supporting the color indicator agent, wherein the matrix agent is a matrix salt; and a stabilizing salt. The cleaning and disinfecting ingredient has a bleaching tendency relative to the color indicator agent such that when the solid color indicator composition is in an aqueous solution of the cleaning and disinfecting ingredient, the presence of the cleaning and disinfecting ingredient in the solution minimizes the display of color in the solution for as long as significant amounts of the cleaning and disinfecting ingredient are present. The continued release of the color indicator agent from the solid color indicator composition after depletion of the ingredient results in a substantial display of color whereby the depletion of the cleaning and disinfecting ingredient can be detected, and such that when the stabilizing salt is in the solution, the cation of the stabilizing salt in the solution displaces the cation of the matrix salt in the solid color indicator composition.

12 Claims, 4 Drawing Figures

CLEANING AND DISINFECTING METHOD AND ARTICLE OF MANUFACTURE INCLUDING COLOR DISPLAY

This application is a continuation-in-part of application Ser. No. 565,720, filed on Dec. 27, 1983, which is a division of Ser. No. 362, 786, filed on Apr. 12, 1982 and now U.S. Pat. No. 4,435, 857; and is a continuation-in-part of applications Ser. No. 385,454, filed on June 7, 1982, Ser. No. 545,876, filed on Oct. 27, 1983 and application Ser. No. 545,883, filed On Oct. 27, 1983.

BACKGROUND OF THE INVENTION

Aqueous calcium hypochlorite mixtures are used for various cleaning and disinfecting purposes, including germ control in swimming pools and disinfecting of toilet bowls and tanks. In many of these uses, it is helpful to include a color indicator in the hypochlorite mixture which will indicate when the hypochlorite concentration is reduced to a level such that the cleaning/disinfecting properties become ineffective or only marginally effective.

Systems for indicating color incorporated in dispensers are disclosed in U.S. Pat. No. 4,171,546 issued to Dirksing, U.S. Pat. No. 4,200,606 issued to Kitko, U.S. Pat. No. 4,208,747 issued to Dirksing, and U.S. Pat. No. 4,216,027 issued to Wages. The Kitko '606 disclosure discusses a system wherein a dye is provided for giving a persistent color to the bowl water between flushes of the toilet. The objective is to assure a consumer that the bowl is being sanitized and means are provided to indicate the time when the disinfectant needs to be replaced. This is accomplished by controlling the quantities of $Ca(OCl)_2$ and color indicator, contained in separate chambers, so that the source of the color indicator is exhausted at about the time the calcium hypochlorite is nearly exhausted.

Other toilet tank dispensers for calcium hypochlorite mixtures have no provisions for indicating by means of color. For example, U.S. Pat. No. 3,837,017 issued to McDuffee discloses a passive system for cleaning toilet bowls wherein a container for calcium hypochlorite is located within a water tank associated with the bowl. A small diameter opening is provided within the top wall of the container to provide exposure to water in the tank so that the compound will be dissolved in the water and thereby delivered to the bowl when the toilet is flushed. An amount of inert particles, such as stone, may be included in the container to cooperate with the small diameter opening for purposes of limiting the rate of removal of the compound from within the container.

U.S. Pat. No. 4,435,857 to Meloy, Meloy application Ser. No. 385,454, filed June 7, 1982, Meloy application Ser. No. 545,883 filed Oct. 27, 1983, Meloy application. Ser. No. 545,876 filed Oct. 27, 1983, and Meloy application. Ser. No. 565,720, incorporated herein by reference, disclose various indicator systems wherein hypochlorite or the like essentially bleaches out the color capability of a selected dye for as long as the hypochlorite is present in sufficient amounts. When the hypochlorite amounts are at or near exhaustion, the dye will provide a color signal indicating that a new supply of hypochlorite is required.

SUMMARY OF THE INVENTION

The present invention relates to a cleaning and disinfecting composition and an improved method for efficiently indicating the presence of sufficient amounts of a disinfecting and/or cleaning agent in an aqueous solution. The invention will be described with particular reference to aqueous hypochlorite solutions or the like which are commonly used in conjunction with toilet tanks and bowls, swimming pools and waste treatment facilities. The aforementioned Meloy applications provide an outline of known solutions of this type. It will be appreciated, however, that the concepts of this invention are applicable to chemical compositions and environments not directly or indirectly referenced herein.

This invention generally involves a cleaning and disinfecting composition and use thereof which includes a cleaning and disinfecting ingredient, which includes a cleaning and disinfecting agent, and a solid color indicator composition having a matrix agent and a color indicator, and which is adapted to release the color indicator at a controlled rate in an aqueous environment. The characteristics of the cleaning and disinfecting ingredient on the one hand, and of the color indicator on the other hand, are such that the latter is all or substantially bleached to a substantially colorless state as long as efficacious amounts of the cleaning and disinfecting agent are present and a substantially clear solution is dispensed during each toilet flush. However, when the cleaning and disinfecting agent is depleted to below efficacious levels, the bleaching capability is lost and a color signal appears. The user is then alerted to the need for changing the dispenser to provide a fresh supply of cleaning and disinfecting ingredient. The invention is particularly related to conservation of the physical integrity of and controlling the elution of dye from the solid color indicator composition when in contact with the aqueous solution of the cleaning and disinfecting ingredient.

In the present invention the solid color indicator composition is in a cohesive form such as a bar or tablet. This color indicator composition includes a matrix agent which is a salt such that the cation in the matrix salt undergoes ion exchange with a cation from a stabilizing salt present in the solution, so that a complex is formed between the cation of the stabilizing salt and at least one anion of the matrix salt. This complex makes the tablet more resistant to degradation by the solution and may retard the elution of color indicator from the tablet. Thus, it has been found that the physical integrity of the solid composition, and the rate of release of the color indicator, can be controlled when the cleaning and disinfecting composition includes a cleaning and disinfecting ingredient which includes a cleaning and disinfecting agent, a solid color indicator composition which includes a color indicator agent and a matrix salt supporting the color indicator agent, and a stabilizing salt such that, when immersed in an aqueous environment, a cation in the matrix is displaced by a cation from the stabilizing salt in the solution. Thus, by including a salt as a matrix agent in the solid color indicator composition and a stabilizing salt in the solution, and by utilizing sufficient color indicator in the tablet or the like based on the calculated life of the cleaning and disinfecting ingredient in the system, the color signal may be reliably provided on an efficient basis.

DESCRIPTION OF THE PREFERRED EMBODIMENT

Figure 1:
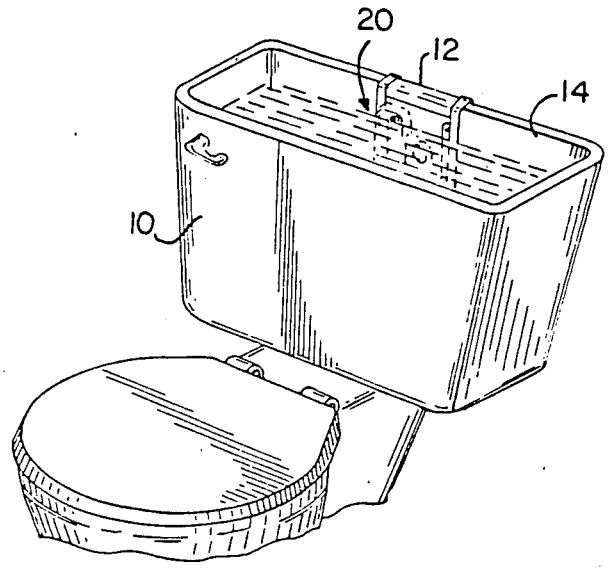
FIG. 1 is a fragmentary perspective view showing a dispenser for a cleaning and disinfecting ingredient associated with a toilet tank.
Figure 2:
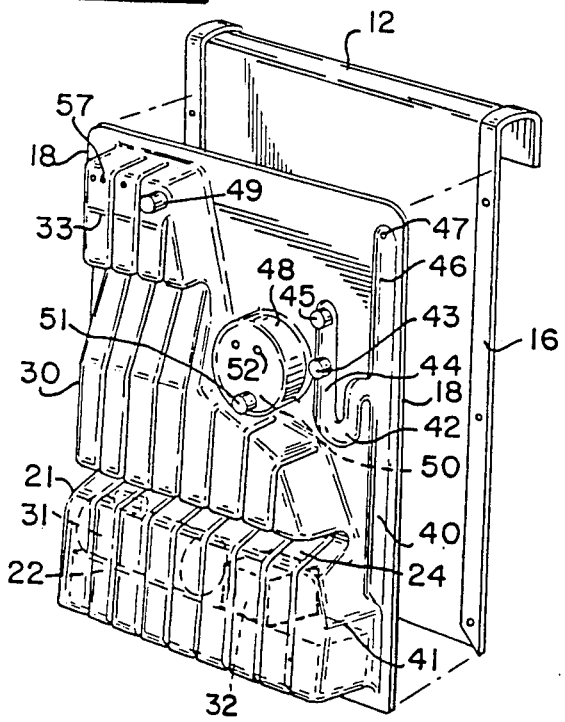
FIG. 2 is a perspective view of a dispenser.

The concepts of this invention contemplate the use of a dispenser which may be of the type illustrated in the aforementioned Meloy applications. The drawings illustrate a dispenser 20 of the type associated with a toilet tank 10. In the embodiment shown, a hanger 12 is employed for suspending the dispenser on the back wall 14 of the tank. As best shown in FIG. 2, the hanger defines overturned side edges 16 which form channels adapted to receive the side edges 18 of the dispenser. The dispenser slides relative to the hanger and frictional engagement between the respective edges enables a homeowner to select the relative positions of the dispenser and hanger during use to accommodate particular conditions.

It will be appreciated that other means could be provided for locating a dispenser in a tank to achieve the purposes of the invention. As already indicated other dispensers of various design may also be used when practicing this invention, including dispensers designed for other applications such as for treating swimming pools and waste treatment facilities.

The dispensing apparatus 20 is positioned in the toilet tank at a level that coincides with water level indicator mark 33 provided on the front wall of the dispenser. The apparatus comprises three chambers, including a reservoir chamber 21 which contains solid disinfectant 22, a solid stabilizing salt 32 and a solid color signal composition 31. A baffle means 24 defines the top of this reservoir chamber.

A volume control chamber 30 is in fluid communication with chamber 21 and is provided with air vent means 49, pinhole vent means 57, and the aforementioned water level line 33.

A delivery tube 40 is in fluid communication with reservoir chamber 21. This tube communicates with this chamber through narrow passage 41 which is located adjacent the end of baffle means 24.

A conduit 42 extends outwardly from one side of the tube 40, and the conduit includes an upwardly extending portion 44. An opening is adapted to be formed at either 43 or 45 in this extension 44 to provide access to the toilet tank water. These openings in combination with water level line 33 cooperate to make the dispenser responsive to the contaminants present in the tank and bowl and to maintain the disinfectant at an effective level.

As best shown in FIG. 2, the openings 43 and 45 are initially closed because the plastic molding operation preferably used in the manufacture of the invention leaves a plastic cap or film over these openings. The user of the construction then has the option of clipping off one or the other of these caps. It has been found that where a system has a high staining potential, the lower cap 43 is preferably clipped off to thereby increase the dosage of a given flush and maintain the disinfectant at an effective level. A lesser dosage is achieved by using the higher opening shown at 45.

The delivery tube 40 also includes a standpipe portion 46. The upper end of this standpipe defines an air vent opening 47 which could be left open during manufacturing or which could also be opened as part of the instructions to the user. The standpipe and associated air vent insure continuous operation of the apparatus free from any air lock.

A third chamber 48 may also be utilized to assist in maintaining the disinfectant at effective levels. This chamber 48 is independent of the other chambers and may, for example, house a sequestering or chelating agent 50 adapted to be dispensed through opening 51 defined by the chamber 48. The opening 51 is preferably covered by a cap or film in the course of the manufacturing operation so that the contents of chamber 48 can be selectively used. Pinhole vent means 52 are provided to permit intake and expelling of air during use.

Figure 4:
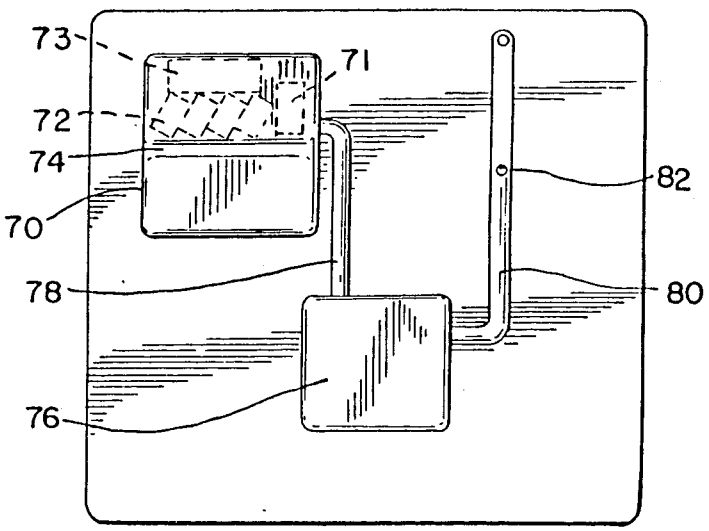
FIG. 4 is an elevational view of an additional alternative form of dispenser.
Figure 3:
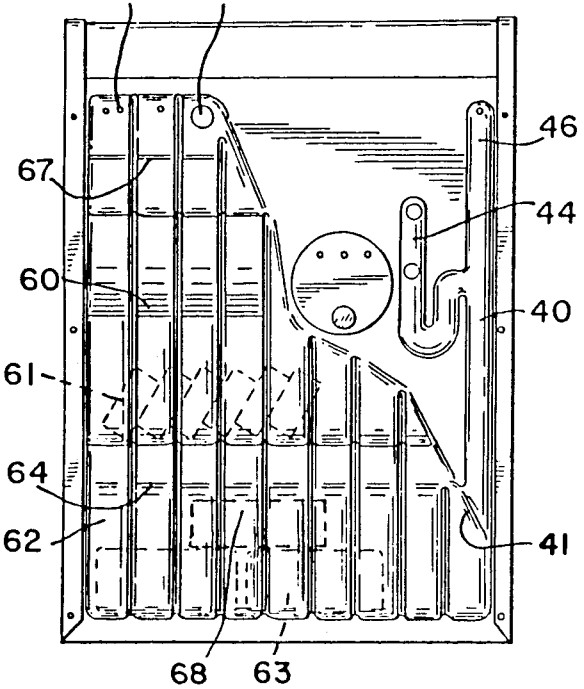
FIG. 3 is an elevational view of an alternative form of dispenser.

Alternative arrangements for locating the color signal and disinfecting ingredients in a dispenser are shown in FIGS. 3 and 4.

In FIG. 3, solid disinfectant 61 is located in volume control chamber 60, and this chamber is in fluid communication with reservoir chamber 62 which contains a solid color signal composition 63 and a solid stabilizing salt 68 positioned immediately below baffle 64. The chamber 60 is also provided with air vent means 65, pinhole vent means 66 and a water level line 67. Except for the translocation of the disinfecting ingredient to the volume control chamber, this dispenser functions similar to that shown in FIG. 2 above.

The construction of FIG. 4 comprises a reservoir chamber 70 which contains color signal tablets 72, a solid stabilizing salt 71 and cleaning and disinfecting ingredient 73 located above baffle 74. The chamber 70 is in fluid communication with chamber 76 through conduit 78. The chamber 76 in turn communicates through conduit 80 with fluid inlet port 82.

Upon immersion of the structure of FIG. 4, tank fluid or the like will enter through port 82, and pass into chambers 70 and 76. A concentrated solution of the cleaning and disinfecting ingredient will pass from chamber 70 into chamber 76 and out through port 82 under appropriate conditions. Such conditions would comprise, for example, flushing of a toilet wherein the water level drops below the level of the chambers provided in the device.

The concentrated solution passing into chamber 76 will also contain the color signal ingredient and the stabilizing salt; however, the color signal containing solution will be bleached by the cleaning and disinfecting agent so that no color will appear in the discharge from chamber 76 until the cleaning and disinfecting agent has been depleted.

In each of FIGS. 2, 3 and 4 the stabilizing salt is depicted as a solid tablet, 32, 68 and 71, respectively, which is distinct from the solid cleaning and disinfecting ingredient and the solid color indicator composition (22 and 31, 61 and 63 and 73 and 72, respectively). However, the present invention contemplates that the stabilizing salt may be incorporated into either or both of the disinfecting and color indicator tablets, so that a separate, stabilizing salt tablet is not necessary. When the stabilizing salt is present as part of the disinfectant tablet and/or as a separate tablet, it is preferred that the tablet containing the stabilizing salt be in the same chamber as the solid color indicator composition so as to maximize the concentration of stabilizing salt in the solution to which the solid color indicator composition is exposed.

It will be appreciated that the arrangements of FIGS. 2, 3 and 4 are illustrated in this application primarily for purposes of establishing that the composition and method of this invention may be utilized in a variety of different systems.

The present invention specifically provides a cleaning and disinfecting composition and an improved method, such as the solid disinfectant ingredient 22 also containing a stabilizing salt, thereby obviating the need for tablet 32, and a solid color indicator composition 31 located in the chamber 21 of the dispenser 20, wherein the matrix of the solid composition is a matrix salt such that the cation of the stabilizing salt in the resulting solution displaces the cation of the matrix salt in the solid composition. This object may be achieved, e.g., where the cleaning and disinfecting ingredient results in an aqueous hypochlorite mixture containing calcium and the solid composition contains sodium stearate.

The stabilizing salt may be any salt which is sufficiently soluble in water to expose the solid color indicator composition to an effective stabilizing concentration. This salt will, of course, be selected so that the cation of the stabilizing salt and the cation of the matrix salt are not the same. Stabilizing salts wherein the cation is an alkaline earth metal, such as Mg and Ca, and Fe, Mn, Co and Al are preferred. Calcium is particularly preferred.

This stabilizing salt may be incorporated into the cleaning and disinfecting composition as a separate tablet. It is preferred, however, that the stabilizing salt be incorporated into at least one of the solid color indicator composition and the cleaning and disinfecting ingredient tablet. In the embodiment of the present invention which is most preferred, the stabilizing salt is selected such that it performs a dual function in the cleaning and disinfecting composition. Thus, the stabilizing salt may also be present as a solubilizing salt incoroorated in the solid color indicator composition, as a filler salt in the cleaning and disinfecting ingredient tablet or as the cleaning and disinfecting agent, e.g. the active component of the cleaning and disinfecting ingredient.

Although only theory, there may be several means by which the composition and method of the present invention help to preserve the physical integrity of the solid color indicator composition and retard the elution of dye therefrom. It may be that the complex formed by the stabilizing salt cation and the matrix salt anion, such as where the stabilizing salt is calcium hypochlorite and the matrix salt is sodium stearate, is less soluble in water than the matrix salt so that less of the matrix is dissolved from the tablet. For example, although sodium stearate is slightly water soluble, calcium stearate is essentially insoluble in water. Further, the complex may be more hydrophobic than the matrix salt. This may result in water being repelled from the solid color indicator tablet surface, thereby retarding elution of the dye.

In the embodiment of the invention which is most preferred, the stabilizing salt and matrix salt are selected such that the valence of the cation of the stabilizing salt is greater that the valence of the matrix cation. This may permit the cation of the stabilizing salt to complex with more than one matrix anion, thereby decreasing the surface porosity of the solid color indicator composition and/or may permit the stabilizing salt cation to become complexed with at least one anion in addition to the matrix anion. This additional anion may serve to at least partially block the tablet pores and/or to repel other anions, such as hypochlorite, from the tablet surface.

Thus, the composition of the present invention preferably is selected so as to cause an additional anion to be present in the aqueous solution. This additional anion may be an anion from another salt present in the cleaning and disinfecting composition, or may be a decomposition product, such as chloride ion resulting from the decomposition of hypochlorite. This additional anion preferably has a radius greater than the atomic radius of the matrix cation. Additional anions selected from the group consisting of chloride, bromide, sulfate, nitrate, carbonate and bicarbonate are preferred; chloride is most preferred.

The solid color indicator composition comprises a dye ingredient for indicating color and a matrix agent which supports the color indicator. The solid composition is in the form of a solid tablet or cake with structural integrity, such as a tablet which has been compressed at a substantial pressure, e.g., from between about 5,000 lbs. and about 25,000 lbs. of die pressure. Preferably, however, the tablet should be manually or machine-pressed at pressures between 2.5 and 12.5 tons per square inch to densities between 1 and 2.25 grams per cubic centimeter. The solid color indicator tablets are so constructed that they generally retain their shape and size while continuously releasing the color indicator to the solution.

The solid color indicator composition preferably comprises from between about 5 and about 40 percent by weight of the matrix agent. Although the matrix agent may be any salt having a cation which may undergo ion exchange with the cation of the stabilizing salt, the matrix agent preferably is a salt selected from the group consisting of alkali metal salts of long chain organic group. This organic anion preferably is an organic carboxylate containing at least 10 carbon atoms. Organic carboxylates containing at least 14 carbon atoms, such as a stearate, palmate, myristate, octadecenate or laurate anion are preferred. Alkali metal stearates, such as sodium stearate, lithium stearate and potassium stearate, and mixtures thereof, are particularly preferred; sodium stearate is most preferred.

In the preferred embodiment, the matrix agent comprises from between about 10 and 30 percent by weight sodium stearate. It is further preferred that a substantial portion of the matrix agent is of a particle size at least as small as 100 mesh in order to facilitate distribution of the matrix agent in the composition.

The color indicator composition also preferably comprises from between about 2 and about 20 percent by weight of a color indicator selected from the group consisting of a hypochlorite relatively stable arylmethane dye and mixtures thereof. In accordance with preferred embodiments of the invention, the color indicator comprises from between about 5 and about 15 percent by weight of a dye selected from the ground consisting of FD & C Blue #1, FD & C Green #3, Intracid Pure Blue V, and mixtures thereof.

The solid color indicator composition also preferably contains a solubilizing agent. This solubilizing agent preferably is a salt selected from the group consisting of alkali metal and alkaline earth metal salts and mixtures thereof. Inorganic salts, such as calcium chloride and sodium chloride are preferred. The solubilizing agent may make up between about 30 and 85 percent by weight of the solid color indicator composition, and most preferably comprises from between about 60 and 80 percent by weight sodium chloride with at least 50 percent by weight of the sodium chloride or the like having a mesh size between about 30 and about 100 prior to blending with the other ingredients. As indicated above, the stabilizing salt may also be a solubilizing agent, thereby minimizing or obviating the need to include a separate solubilizing agent. In this instance considerations relevant to selection of the stabilizing salt, discussed above, will also be relevant.

In a preferred embodiment of the invention, the color indicator tablets or the like may also be coated with a protective coating comprising a shellac, a lacquer, or mixtures thereof. This coating will protect the compositions of the invention from air, humidity, etc., minimize dusting and make handling easier, and delay wetting of the composition when it is immersed in a container containing calcium hypochlorite.

It is further preferred that a binder be added to the color indicator composition to assist in maintaining the physical integrity of the tablet. This binder may be any of a number of known, commercially available binders, such as microcrystalline cellulose.

The color indicator tablets useful in the present invention also preferably have a critical porosity. With reference to this critical porosity, it has been observed that there is a correlation between the porosity of a tablet or the like and the rate of controlled release in a bleach solution of the color indicator and the duration of physical integrity of the tablet. Porosity for the purposes of the present invention is defined as the volume percentage of a petroleum distillate such as kerosene which is absorbed by the tablet under test conditions. This porosity may be further described as the controlled release structure developed in the tablet, this structure comprising a labryinth of channels and passageways that are created when the blend of matrix agent and color indicator, and preferably solubilizing agent, are compressed under various conditions such as described in Table I below.

Tests for determining porosity may be carried out as follows. Tablet density is determined by dropping uncoated tablets weighed to the nearest 0.01 g into approximately 9 cc odorless kerosene (Fisher K-10) contained in a 25 ml graduated cylinder. A reading is promptly taken on the graduated cylinder before appreciable absorption has had time to occur. Density is then determined by using the following equation:

$$\text{density (g/cc)} = \frac{\text{weight tablets, g.}}{\text{final vol. (cc)} - \text{initial vol. (cc)}}$$

Uncoated tablets are then weighed to the nearest 0.01 g, immersed in odorless kerosene (Fisher K-10), and subjected to water aspirator vacuum for 15 minutes or allowed to stand at atmospheric pressure for two hours. The liquid is decanted and excess surface liquid removed. Final weight is then determined to the nearest 0.01 g and the porosity determined using the following equation:

$$\text{Porosity (\% void by vol.)} = \frac{\dfrac{\text{final wt. (g)} - \text{Initial wt. (g)}}{\text{Kerosene density (g/cc)}}}{\dfrac{\text{Initial wt. (g)}}{\text{tablet density (g/cc)}}} \times 100$$

In accordance with the preferred embodiment of the invention, the porosity of the tablets preferably should be 10% or less by volume and more preferably between about 4% and 8% by volume. It has been found that when the porosity of tablets is excessive, then the controlled rate of release of the color indicator may possibly not be obtained and the tablet can be exhausted of color indicator or may disintegrate before the bleach concentration of the aqueous bleach medium being monitored falls below an effective level. In such cases, a tablet may become exhausted of color in less than 30 days which will ordinarily be prior to the exhaustion of the toilet bowl cleaner being monitored.

The following Table I provides examples of suitable compositions, it being understood that reference may be made to the aforementioned Meloy applications for other examples. The porosity of the tablets suitable for the preferred embodiment invention can be obtained by a combination of elements including processing variables and composition variables. An example of preferred conditions for making tablets useful in the present invention is found in the Example 1 below.

The processing tests conducted have confirmed a critical porosity for the tablets of less than about 10% and preferably between about 4% and about 8% by volume. Since this critical porosity is a function of processing variables such as pressure, development time, dwell time, type of press and formulation variables, such as mesh size of the solubilizing agent, when included, and type of concentration of matrix and solubilizing agent, the desired porosity can be obtained by a combination of one or more of these. It has been determined, however, that the tablet should be manually or machine-pressed at pressures between 2.5 and 12.5 tons per square inch to densities between 1 and 2.25 grams per cubic centimeter.

TABLE I

| Example | Color Indicator % by Wt. | Solubilizing Agent/Sol. Salt % by Wt. | Matrix Agent/ Matrix Salt % by Wt. | Compression In Lbs. |
|---|---|---|---|---|
| I | Intracid Blue V/10 | NaCl/70 | Sodium Stearate/20 | 5,000 |
| II | Intracid Blue V/5 | NaCl/70 | Sodium Stearate/25 | 10,000 |
| III | Intracid Blue V/2 | NaCl/70 | Sodium Stearate/28 | 20,000 |
| IV | Intracid Blue V/20 | KCl/40 | Sodium Stearate/40 | 15,000 |
| V | Intracid Blue V/15 | KCl/80 | Sodium Stearate/5 | 25,000 |
| VI | Intracid Blue V/8 | KCl/72 | Sodium Stearate/20 | 25,000 |
| VII | FD & C Green #3/10 | NaCl/70 | Sodium Stearate/20 | 15,000 |
| VIII | FD & C Green #3/5 | NaCl/70 | Sodium Stearate/25 | 10,000 |
| IX | FD & C Green #3/2 | NaCl/70 | Sodium Stearate/28 | 15,000 |
| X | FD & C Green #3/20 | KCl/40 | Sodium Stearate/40 | 20,000 |
| XI | FD & C Green #3/15 | KCl/80 | Sodium Stearate/5 | 25,000 |
| XII | FD & C Green #3/8 | KCl/72 | Sodium Stearate/20 | 15,000 |

The cleaning and disinfecting ingredient includes a cleaning and disinfecting agent which displays cleaning and disinfecting properties when in aqueous solution. Any suitable compound which yields active chlorine or active oxygen in aqueous solution may be employed to advantage, particularly materials used as bleaching agents. A highly preferred bleaching and disinfecting ingredient is one which yields a hypochlorite species in aqueous solution, the hypochlorite ion being chemically represented by the formula —OCl. The hypochlorite ion is a strong oxidizing agent and, for this reason, materials which yield this species are considered to be powerful disinfecting agents.

Those disinfecting agents which yield a hypochlorite species in aqueous solution include hypochlorites, hypochlorite addition products, chloramines, chlorimines, chloramides, and chlorimides. Specific examples of compounds of this type consistent with the present invention include lithium hypochlorite, calcium hypochlorite, calcium hypochlorite dihydrate, monobasic calcium hypochlorite, dibasic magnesium hypochlorite, chlorinated trisodium phosphate dodecahydrate, potassium dichloroisocyanurate, trichlorocyanuric acid, sodium dichloroisocyanurate, sodium dichloroisocyanurate dihydrate, 1,3-dichloro-5.5-dimethylhydantoin, N-chlorosulfamide, Chloramine T, Dichlormaine T., Chloramine B and Dichloramine B.

Examples of disinfecting agents which yield active oxygen in aqueous solution are sodium perborate and potassium monopersulfate ($KHSO_5$). However, hypochlorite is most preferred. In the embodiment of the invention which is most preferred, the stabilizing salt is also a cleaning and disinfecting agent as the presence of the stabilizing salt is desired only as long as effective amounts of the cleaning and disinfecting agent are present in the solution. In this embodiment the cleaning and disinfecting agent will include a cation which may displace the cation of the matrix salt. For this reason hypochlorites of alkaline earth metals, such as calcium and magnesium, are preferred; calcium hypochlorite is most preferred.

Cleaning and disinfecting agents of the type described above may comprise from about 10% to about 100% of the disinfecting ingredient by weight when utilized in conjunction with the practice of the present invention.

Although there are circumstances where the use of such disinfecting ingredient in a loose granule form may be advantageous, generally, it is preferable to compress the disinfectant ingredient into a tablet or cake with the use of equipment such as tableting presses, extruders, etc. Such compaction helps to regulate the solubility of the disinfecting agent while allowing for a more efficient use of space in relation to the size and fit of a construction into the toilet tank of a flushing toilet.

The cleaning and disinfectant ingredient preferably also includes a noninterfering inorganic filler salt which may act as a filler and help to stabilize the cleaning and disinfectant agent. For solid systems containing bleach, it is generally suitable to include a stabilizer for the bleaching cleaning and disinfecting agents. For some types of bleaching agents, particularly oxygen bleaching agents, this material can be a water-soluble filler agent selected from the group consisting of alkali metal, alkaline earth material, ammonium and substituted ammonium salts of an acid having an ionization constant at 25° C., for the first hydrogen, of at least about $1\times10^{-3}$. Appropriate filler salts include the alkali metals alkaline earth metals, ammonium, and substituted ammonium sulfates, bisulfates, nitrates, silicates, chiorides, phosphates, pyrophosphates, polyphosphates and hexametaphosphates. Specific examples of such materials include magnesium sulfate, sodium sulfate, potassium sulfate, ammonium sulfate, lithium sulfate, dimethylammonium sulfate, sodium chloride, lithium chloride, potassium chloride, sodium bisulfate, potassium bisulfate, ammonium bisulfate, sodium nitrate, magnesium nitrate,, calcium nitrate, sodium tripolyphosphate, trisodium phosphate, sodium metaphosphate, sodium hexametaphosphate, potassium pyrophosphate, sodium tetraphosphate, sodium silicate, and sodium metasilicate. Stabilizing agents of this type are described more fully in U.S. Pat. No. 3,639,285 issued to Niesen. As indicated above, the matrix stabilizing salt may be selected so that it may be incorporated into the composition of the present invention as the filler salt, although this is less preferred than the embodiment wherein the stabilizing salt is the cleaning and disinfecting agent. In this embodiment, considerations discusssed above regarding the matrix stabilizing salt will be relevant to selection of the filler salt.

For chlorine bleaching agents, particularly N-chloroimides, a highly preferred filler agent is sodium acetate. Use of this material as a bleach stabilizer is described more fully in U.S. Pat. No. 3,829,385 issued to Abbot, et al. In solid compositions suitable for use in the practice of the present invention, such disinfectant stabilizing filler salts are preferably utilized to the extent of from about 1% to about 90% by weight of the composition.

It is noteworthy that preferred disinfectant containing tablets employed in practicing the present invention have a specific dissolution characteristic. In particular, disinfectant tablets suitable for use in practicing the present invention, when submerged in water, release active ingredients to form an aqueous solution of the disinfectant and soluble inorganic filler salts.

According to the method of the present invention, it is preferred that the solution to which this solid color indicator composition is initially exposed contains a concentration of stabilizer salt cation sufficient to encourage early formation of a surface barrier in the solid color indicator composition. In the preferred embodiment, the initial concentration of the stabilizing salt cation in the solution should be such that sufficient stabilizing cations are present to complex substantially all of the matrix anions present at the color indicator tablet surface. In the embodiment which is most preferred, wherein the solid color indicator composition comprises about 10 to 30% by weight sodium stearate and the stabilizing salt contains calcium it is preferred that the solution initially contain at least 2% by weight calcium. More preferably, the initial calcium concentration is at least 3% by weight. Initial calcium concentrations of 6% by weight or more are most preferred.

SPECIFIC EMBODIMENTS

Example 1

Solid color indicator tablets for use in the present invention were made by the following procedure: FD & C Green #3 dye (8 lbs.) and sodium stearate (16 llbs.), having a particle size such that 93% would pass thru 100 mesh, were placed in a vaned rotary drum mixer and mixed for 5 minutes. Sodium chloride (54.4 lbs.) was added, and mixing continued. After 2 minutes microcrystalline cellulose (1.6 lbs.) was added and mixing continued for 6 minutes. This resulted in a homogeneous powder which was pressed into 3 gram, 9/16"×9/16" tablets on a rotary tablet press at a pressure of approximately 17,000 lbs. The tablets were dusted with sodium stearate and coated 3 to 4 times with shellac.

Examples 2–6

Experiments were conducted to demonstrate aspects of the present invention.

Tablets (9/16"×9/16; weight approximately 3g.) were produced on a Stokes rotary press according to the following formulations:

68% sodium chloride
20% sodium stearate
10% FD&C Green #3 dye
2% microcrystalline cellulose (Percentages indicated above are percent by weight.)

In each of Examples 2–6 one of these tablets was placed in a beaker containing one of the aqueous solutions indicated below in Table II. Concentrations of the solutions for tablet exposure were chosen so that the concentration of calcium or hypochlorite, whichever was applicable, was equivalent from solution to solution. That is, when calcium hypochlorite solution was used versus lithium hypochlorite solution, concentrations were chosen such that the hypochlorite concentration was equal in the two solutions, and when calcium hypochlorite solution was used versus calcium chloride solution, concentrations were chosen such that the calcium concentration was equal in the two solutions.

Solutions were remade fresh at intervals during the total exposure time to maintain original concentrations, and the solutions, with the tablets present, were stirred 2 or 3 times a day to prevent saturation or other concentration effects from occuring in the immediate vicinity of the tablets. After 7 days the tablets were examined.

In the following descriptions, floatation of the dye tablets is referred to. Dye tablets float when enough of the sodium chloride solubilizing salt dissolves away to make the tablets less dense than the solution they are in contact with. Virtually all tablets will float given enough time but on the shorter term, the length of time required for a tablet to become buoyant gives an indication of the extent of the surface barrier established through ion exchange between the stabilizing salt and the matrix salt. Creation of a surface barrier will slow dissolution of the tablets' sodium chloride content, therefore lengthening the time to buoyancy.

Also referred to in Table II, is overnight solution color. This is the color developed on dropping the dye tablet into the test solution, after the tablet has stood in the solution overnight. Tablet interior color is the color observed on cutting the tablet in half after the solution exposure time. Intensity of the observed colors is indicated by the abbreviations v. lt., very light; lt., light; med., medium; and dk., dark. In the tables below "NA" means "not available".

TABLE II

| Ex. No. | Solution Concentration | Tablet Property | Solution: Calcium Hypochlorite | Solution: Lithium Hypochlorite | Solution: Calcium Chloride |
|---|---|---|---|---|---|
| 2 | 0% | Cracking or Erosion | Yes | Yes | Yes |
| | | Floating | Yes | Yes | Yes |
| | | Overnight solution color | dk. blue | dk. blue | dk. blue |
| | | Tablet interior color | NA | lt. blue | lt-med. blue |
| | | Tablet strength | NA | semi-firm | semi-firm |
| 3 | 1% | Cracking or Erosion | Yes | Yes | No |
| | | Floating | Yes | Yes | No |
| | | Overnight solution color | dk. blue | None | dk. blue |
| | | Tablet interior color | NA | white | dk. blue |
| | | Tablet strength | NA | semi-firm | firm |
| 4 | 2% | Cracking or Erosion | Yes | Yes | No |
| | | Floating | Yes | Yes | No |
| | | Overnight solution color | dk. blue | none | dk. blue |
| | | Tablet interior color | NA | white | dk. blue |
| | | Tablet strength | NA | semi-firm | firm |
| 5 | 4% | Cracking or Erosion | No | Yes | No |
| | | Floating | No | Yes | No |
| | | Overnight solution color | dk. blue | dk. blue | dk. blue |
| | | Tablet interior color | NA | dk. blue | dk. blue |
| | | Tablet strength | NA | semi-firm | firm |
| 6 | 8% | Cracking or Erosion | No | Yes | No |
| | | Floating | No | Yes | No |
| | | Overnight solution color | dk. blue | med. green | dk. blue |
| | | Tablet interior color | NA | dk. blue | dk. blue |
| | | Tablet strength | NA | semi-firm | firm |

Examples 7–10

The ion exchange between the ingredient salt in the solution and the matrix salt in the solid color indicator composition was demonstrated by a set of experiments wherein several tablets, of the tablet formulation indicated above for Examples 2–6, were placed in aqueous solutions of 0%, 1%, 3% and 6% calcium hypochlorite. At the time intervals indicated, a tablet was removed from each of these solutions. These tablets were washed, dried, and the outer 1 millimeter of the surface analyzed for calcium. At the end of 6 days (approximately 146 hours), the remaining tablets were dropped in fresh, distilled water. The results of these experiments are shown below in Table III.

TABLE III

| Hours | Ex. No. | % Calcium Hypochlorite | % Calcium, Tablet Surface | Solution Color | Tablet Cracked | Tablet Strength | Tablet Interior |
|---|---|---|---|---|---|---|---|
| 5 | 7 | 0 | 0.23 | blue | no | hard | dk blue |
| | 8 | 1 | 0.35 | lt blue | no | hard | dk blue |
| | 9 | 3 | 1.03 | lt blue | no | hard | dk blue |
| | 10 | 6 | 1.84 | none | no | hard | dk blue |
| 24 | 7 | 0 | 0.40 | dk blue | NA | NA | NA |

TABLE III-continued

| Hours | Ex. No. | % Calcium Hypochlorite | % Calcium, Tablet Surface | Solution Color | Tablet Cracked | Tablet Strength | Tablet Interior |
|---|---|---|---|---|---|---|---|
| | 8 | 1 | 0.82 | none | NA | NA | NA |
| | 9 | 3 | 3.16 | none | NA | NA | NA |
| | 10 | 6 | 3.33 | none | NA | NA | NA |
| 96 | 7 | 0 | 0.54 | dk blue | yes | very soft | med blue |
| | 8 | 1 | 3.50 | ** | yes | soft | dk blue |
| | 9 | 3 | 6.90 | none | no | semi firm | dk blue |
| | 10 | 6 | 7.05 | none | no | firm | dk blue*** |
| 146 | 7 | 0 | 0.94 | dk blue | yes | very soft | med blue |
| | 8 | 1 | 4.60 | ** | yes | soft | med blue green |
| | 9 | 3 | 10.47 | none | no | firm | dk blue |
| | 10 | 6 | 8.85 | none | no | firm | dk blue |
| 170(24*) | 7 | 0 | 0.88 | med blue | yes | very soft | lt med blue |
| | 8 | 1 | 4.00 | med blue | yes | soft | med blue |
| | 9 | 3 | 8.68 | dk blue | no | firm | dk blue |
| | 10 | 6 | 8.01 | dk blue | no | firm | dk blue |
| 196.5(50.5*) | 7 | 0 | 0.80 | med blue | yes | very soft | lt med blue |
| | 8 | 1 | 4.10 | med blue | yes | soft | med blue |
| | 9 | 3 | 8.12 | dk blue | no | firm | dk blue |
| | 10 | 6 | 7.79 | dk blue | no | firm | dk blue |

*Hours in fresh dist. water
**Blue color in immediate vicinity of tablets, disappears on stirring
***Small sphere at center still dry It will be understood that various changes and modifications may be made in the above-described invention without departing from the spirit thereof as defined in the following claims.

I claim:

1. An article of manufacture comprising a dispenser adapted for suspension in a tank containing a solution including water, the dispenser defining means for storing:

(a) a cleaning and disinfecting ingredent whicn includes a cleaning and disinfecting agent;

(b) a solid color indicator composition which includes a color indicator agent and a matrix agent supporting said color indicator agent, said matrix agent comprising a matrix salt having a cation; and, (c) stabilizing salt having a cation; and, said dispenser including chamber means for receiving amounts of solution, and means defined by the dispenser permitting entry and egress of solution relative to said chamber means whereby solution from said tank can enter said chamber means and solution from said chamber means can be dispensed into said tank, said dispenser also providing means for maintaining communication between the said chamber means and said means for storing said ingredient, said composition and said stabilizing salt such that the presence of a solution in the dispenser will form an aqueous solution within the dispenser which includes said stabilizing salt and said cleaning and disinfecting ingredient, the presence of said stabilizing salt in said aqueous solution resulting in the cation of the stabilizing salt displacing the cation of the matrix salt in the solid color indicator composition, said cleaning and disinfecting ingredient comprising a material that has a bleaching tendency relative to said color indicator agent whereby the display of color in the solution is at least minimized for as long as significant amounts of the cleaning and disinfecting ingredient are present, the relative amounts of said cleaning and disinfecting ingredient and of said color indicator agent stored in said dispenser being such that said cleaning and disinfecting ingredient is depleted first whereby the continued release of the color indicator agent from said solid color indicator composition after depletion of the ingredient results in as substantial display of color whereby the depletion of the cleaning and disinfecting ingredient can be detected.

2. The composition of claim 1 wherein the cation of the stabilizing salt has a valence greater than the valence of the cation of the matrix salt.

3. The article of manufacture of claim 1 wherein the matrix cation of the matrix salt is selected from the group consisting of alkali metals.

4. The article of manufacture of claim 3 wherein the matrix salt is sodium stearate.

5. The article of manufacture of claim 1 wherein the cation of the stabilizing salt is selected from the group consisting of Ca, Mg, Mn, Fe, Co and Al.

6. The article of manufacture of claim 5 wherein the stabilizing salt is calcium hypochlorite.

7. The article of manufacture of claim 1 wherein the matrix anion is an organic ion containing at least 10 carbon atoms.

8. The article of manfuacture of claim 6 wherein said solid color indicator composition includes a solubilizing agent which is a salt.

9. The article of manufacture of claim 8 wherein the stabilizing salt is a solubilizing salt.

10. The article of manufacture of claim 1 wherein said cleaning and disinfecting ingredient includes a filler salt.

11. The article of manufacture of claim 1 wherein said stabilizing salt is a filler salt.

12. An improved method for detecting the depletion of a cleaning and disinfecting ingredient in a tank containing a solution including water and initially containing the ingredient, said method comprising placing a dispenser in an aqueous medium, said dispenser defining means for storing a cleaning and disinfecting combination which includes:

(a) a cleaning and disinfecting ingredient which includes a cleaning and disinfecting agent;

(b) a solid color indicator composition which includes a color indicator agent and a matrix agent supporting said color indicator agent, said matrix agent comprising a matrix salt having a cation; and, (c) a stabizing salt having a cation;

said dispenser including chamber means for receiving amounts of the solution, and means defined by the dispenser permitting entry and egress of solution relative to said chamber means whereby solution from said tank can enter said dispenser and solution from said chamber means can be dispensed into said tank, bridging said ingredient, said composition and said salt together with said solution within said chamber means and maintaining communicaton between said chamber means and said means for storing said ingredient, said composition and said stabilizing salt for thereby forming within the dispenser an aqueous solution, said aqueous solution including said stabilizing salt and said cleaning and disinfecting ingredient, the presence of said stabilizing salt in said aqueous solution resulting in the cation of the stabilizing salt displacing the cation of the matrix salt in the solid color indicator composition, said cleaning and disinfecting ingredient comprising a material that has a bleaching tendency relative to said color indicator agent such that the display of color in the solution is at least minimized for as long as significant amounts of the cleaning and disinfecting ingredient are present, the relative amounts of said cleaning and disinfecting ingredient and of said color indicator agent stored in said dispenser being such that said cleaning and disinfecting ingredient is depleted first whereby the continued release of the color indicator agent from said solid color indicator composition after depletion of tne ingredient results in a substantial display of color whereby the depletion of the cleaning and disinfecting ingredient can be detected.

* * * * *